US006052835A

United States Patent [19]

O'Shea

[11] Patent Number: 6,052,835

[45] Date of Patent: Apr. 25, 2000

[54] PROTECTIVE HEAD GEAR

[76] Inventor: Eamon D. O'Shea, 4820 Portage Road, Niagara Falls, Ontario, Canada, L2E 6B3

[21] Appl. No.: 09/249,767

[22] Filed: Feb. 16, 1999

[51] Int. Cl.[7] ..... A42B 3/00

[52] U.S. Cl. ..... 2/468; 2/461; 2/425

[58] Field of Search ..... 2/410, 411, 421, 2/422, 425, 455, 459, 461, 462, 468

[56] References Cited

U.S. PATENT DOCUMENTS

| | | | |
|---|---|---|---|
| 3,134,106 | 5/1964 | Shaffer et al. | 2/462 |
| 5,159,715 | 11/1992 | Jurga et al. | 2/462 |
| 5,261,124 | 11/1993 | Cartwright et al. . | |
| 5,287,562 | 2/1994 | Rush, III . | |
| 5,295,271 | 3/1994 | Butterfield et al. . | |
| 5,313,670 | 5/1994 | Archer, III . | |
| 5,353,437 | 10/1994 | Field et al. | 2/425 |
| 5,371,905 | 12/1994 | Keim . | |
| 5,390,367 | 2/1995 | Rush, III . | |
| 5,404,590 | 4/1995 | Monica, Jr. . | |
| 5,444,870 | 8/1995 | Pinsen . | |
| 5,493,736 | 2/1996 | Allison . | |
| 5,517,699 | 5/1996 | Abraham, II | 2/425 |
| 5,581,816 | 12/1996 | Davis . | |
| 5,581,820 | 12/1996 | Cartwright et al. . | |
| 5,715,541 | 2/1998 | Landau | 2/425 |
| 5,794,270 | 8/1998 | Howat | 2/410 |

FOREIGN PATENT DOCUMENTS

| | | | |
|---|---|---|---|
| 627567 | 10/1927 | France | 2/468 |
| 2825145 | 12/1979 | Germany | 2/410 |

*Primary Examiner*—Michael A. Neas

*Attorney, Agent, or Firm*—Nancy E. Hill; Lynn C. Schumacher; Hill & Schumacher

[57] ABSTRACT

A protective head gear includes a generally open head portion and a collar portion. The protective head gear is for use in contact sports by an athlete wearing a helmet. The head portion is generally open and has a crown segment and a pair of opposed side segments. The crown segment has a crown base and each side segment has a side base. The head portion is spaced upwardly and outwardly from the helmet. The crown segment and each side segment are contoured to and spaced from the shape of the helmet. The collar portion is hingeably connected to the crown base. The collar portion having a generally rigid layer adapted to be positioned around the athlete's neck and to transmit the force from a hit on the head portion to the collar portion. In use, the collar portion is attached to the athlete.

20 Claims, 9 Drawing Sheets

PROTECTIVE HEAD GEAR

FIELD OF THE INVENTION

This invention relates to protective head gear and in particular to protective head gear for use in sports particularly hockey.

BACKGROUND OF THE INVENTION

In many sporting activities there is a risk of injury when a player hits his/her head. In particular, when there is a direct hit on the top of a player's head, the player could suffer a wide range of injuries, from a concussion to permanent paralysis. Some athletes who have sustained direct hits to the top of their head have ended up as paraplegics and quadriplegics.

In view of the risk of injury a number of head gear devices have been suggested to help reduce the risk of spinal injury. For example, U.S. Pat. No. 5,715,541 issued Feb. 10, 1998 to Landau shows a device which includes a sleeveless jacket worn about the user's torso, a head shield shaped to cover the user's head and rigid supports extending from the jacket to the head shield. Another head gear arrangement is shown in U.S. Pat. Nos. 5,261,125 and 5,581,820 issued Nov. 16, 1993 and Dec. 10, 1996, respectively, and both issued to Cartwright et al. These patents show a helmet connected to an arm which in turn is attached to a vest worn about the torso.

Alternatively a number of protective head gear devices have been designed primary for use in football. For example U.S. Pat. No. 5,581,816 issued on Dec. 10, 1996 to Davis shows a football-type helmet attached to shoulder pads. The shoulder pads have tracks attached thereto and side connections which are attached to the helmet run in the tracks. Somewhat similarly, U.S. Pat. No. 5,517,699 issued May 21, 1996 to Abraham shows a football-type helmet adapted to provide protection from spinal injuries. Abraham shows a protective hood with rigid side supports that is designed to fit over a helmet and is hingeably attached at the side to the shoulder pad. U.S. Pat. No. 5,444,870 issued August 1995 to Pinsen shows a helmet and shoulder pad combination that includes spaced apart inner and outer helmet portions with a plurality of springs therebetween. A generally concentric guide having outer and inner portions is attached to the shoulder pads and an inner element attached to the helmet is positioned between outer and inner portions. U.S. Pat. No. 5,371,905 issued Dec. 13, 1994 to Keim shows a somewhat different device. Keim shows a helmet which is attached to shoulder pads with a fluid dampening mechanism or a shock absorber. The fluid dampening mechanism has limits at either end to limit the hyper-flexion and hyper-extension. All of these devices have attachments or devices attached to a football type helmet which directly restrict the movement of the helmet.

Other devices have been suggested such as head gear with inflatable bags or head gear with gas chambers therein. For example, the two Rush III, U.S. Pat. No. 5,390,36, issued Feb. 21, 1995 and U.S. Pat. No. 5,287,562 issued February 1994 which show two embodiments of helmets designed to protect spinal injuries. In the one embodiment there is provided an inflatable bag that is triggered by a predetermined force on the crown of the helmet. In a second embodiment there are a plurality of cylinders that are molded into the outside of the helmet. A piston is positioned inside the cylinder and is attached to a generally rigid ring like member that in the retracted position is positioned around the bottom of the helmet. The cylinders are connected to a gas chamber so that when the helmet is hit with a predetermined force the pistons move downwardly until the ring engages the shoulders or shoulder pads of the user. Somewhat similarly Archer shows an enclosed helmet with an inflatable air bag.

Alternative devices show shoulder pads that have attachments for restricting the movement of the helmet downwardly. For example U.S. Pat. No. 5,404,590 issued Apr. 11, 1995 to Monica, Jr. is directed to a restraining collar that extends upwardly from shoulder pads to restrict the movement of a helmet. Another example is U.S. Pat. No. 5,493,736 issued Feb. 27, 1996 to Allison which is directed to a helmet with protrusions extending outwardly therefrom and corresponding posts extending upwardly from the shoulder pad so that the downward motion of the helmet is restricted by the protrusions engaging the posts.

None of these devices appear to be generally used by amateur or professional athletes. In particular none of these devices appear to be used by hockey players. Some of these devices are complex devices that would be costly to manufacture. Further, many of the devices include interactive components that are proximate to the athlete's face. Others would restrict the rotational movement of the athlete's head. Still others include chemicals for inflating air bags and the like.

Accordingly, it would be advantageous to provide a protective head gear that, while it protects the head when hit on the top of the head, allows for rotational movement of the athlete's head. Further, it would be advantageous to provide head gear that minimizes the risk of spinal injury while minimally changing the protective gear currently being worn. Still further it would be advantageous to provide a protective head gear that is generally open and that can easily be disengaged such that when an athlete is not in play such as between periods or during a penalty the athlete can move the head gear so that he/she can freely move their head.

SUMMARY OF THE INVENTION

A protective head gear is provided that transmits the force of a hit on a head portion to a collar portion. The protective head gear is for use by an athlete wearing a helmet. The protective head gear is spaced from the helmet so that the athlete can move his/her head from side to side but it restricts motion up and down.

A protective head gear is provided which includes a generally open head portion and a collar portion. The protective head gear is for use in contact sports by an athlete wearing a helmet. The head portion is generally open and has a crown segment and a pair of opposed side segments. The crown segment has a crown base and each side segment has a side base. The head portion is spaced upwardly and outwardly from the helmet. The crown segment and each side segment are contoured to and spaced from the shape of the helmet. The collar portion is hingeably connected to the crown base. The collar portion having a generally rigid layer adapted to be positioned around the athlete's neck and to transmit the force from a hit on the head portion to the collar portion. In use, the collar portion is attached to the athlete.

Further features of the invention will be described or will become apparent in the course of the following detailed description.

BRIEF DESCRIPTION OF THE DRAWINGS

The invention will now be described by way of example only, with reference to the accompanying drawings, in which.

DETAILED DESCRIPTION OF THE INVENTION

Figure 1:
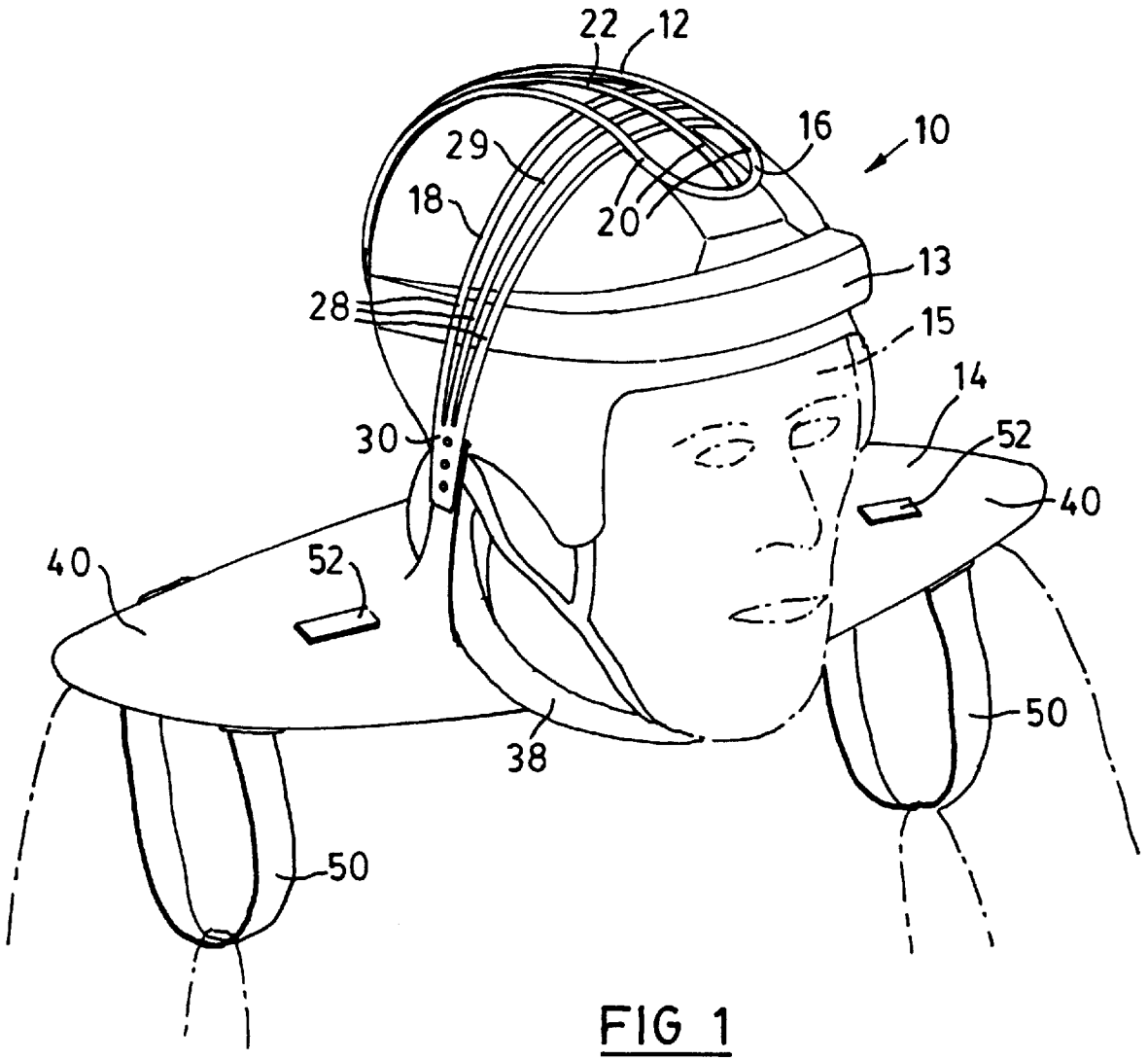
FIG. 1 is a perspective view of the protective head gear of the present invention shown with an athlete wearing a hockey type helmet.
Figure 2:
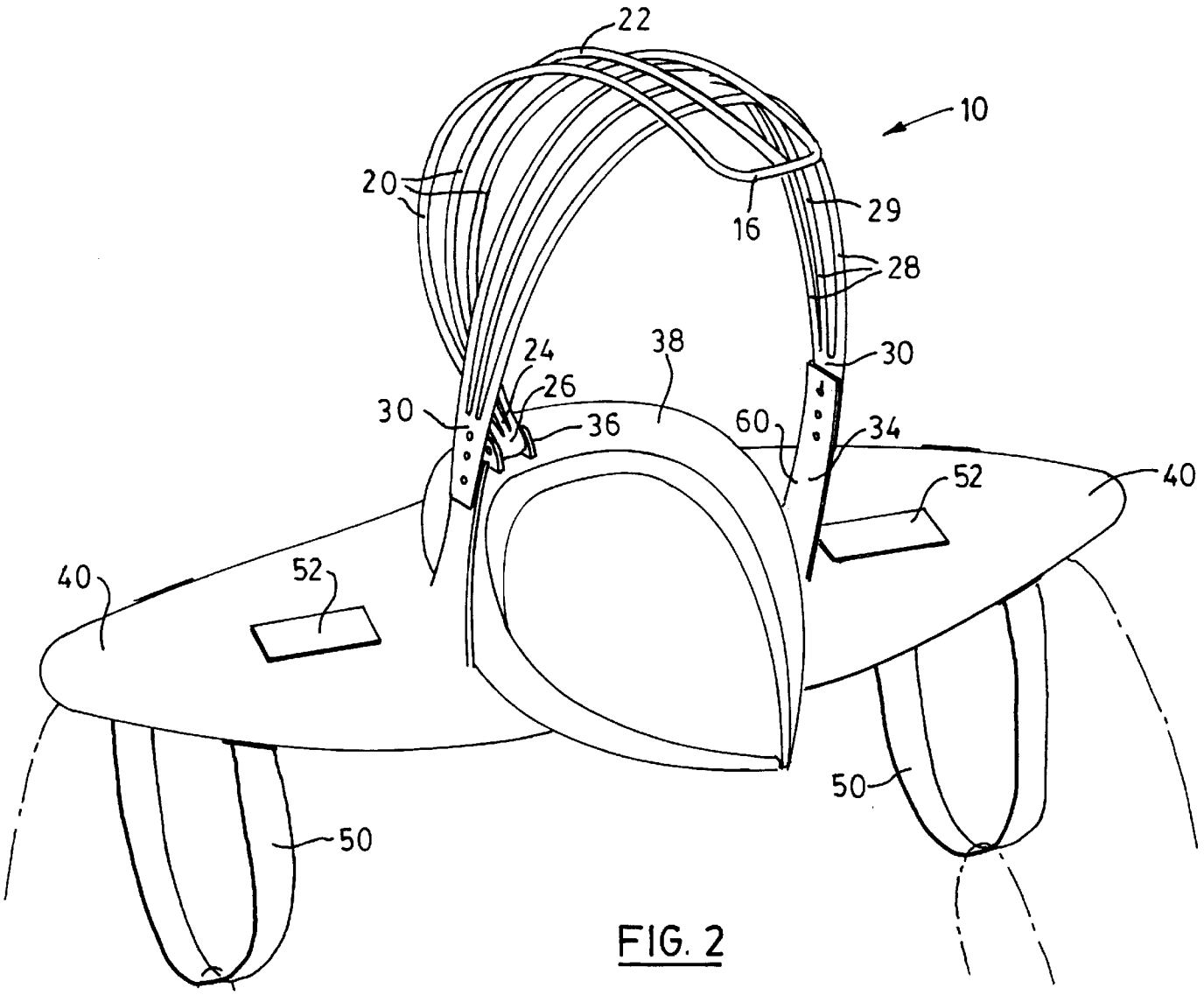
FIG. 2 is an enlarged perspective view similar to FIG. 1 but showing the protective head gear only.
Figure 3:
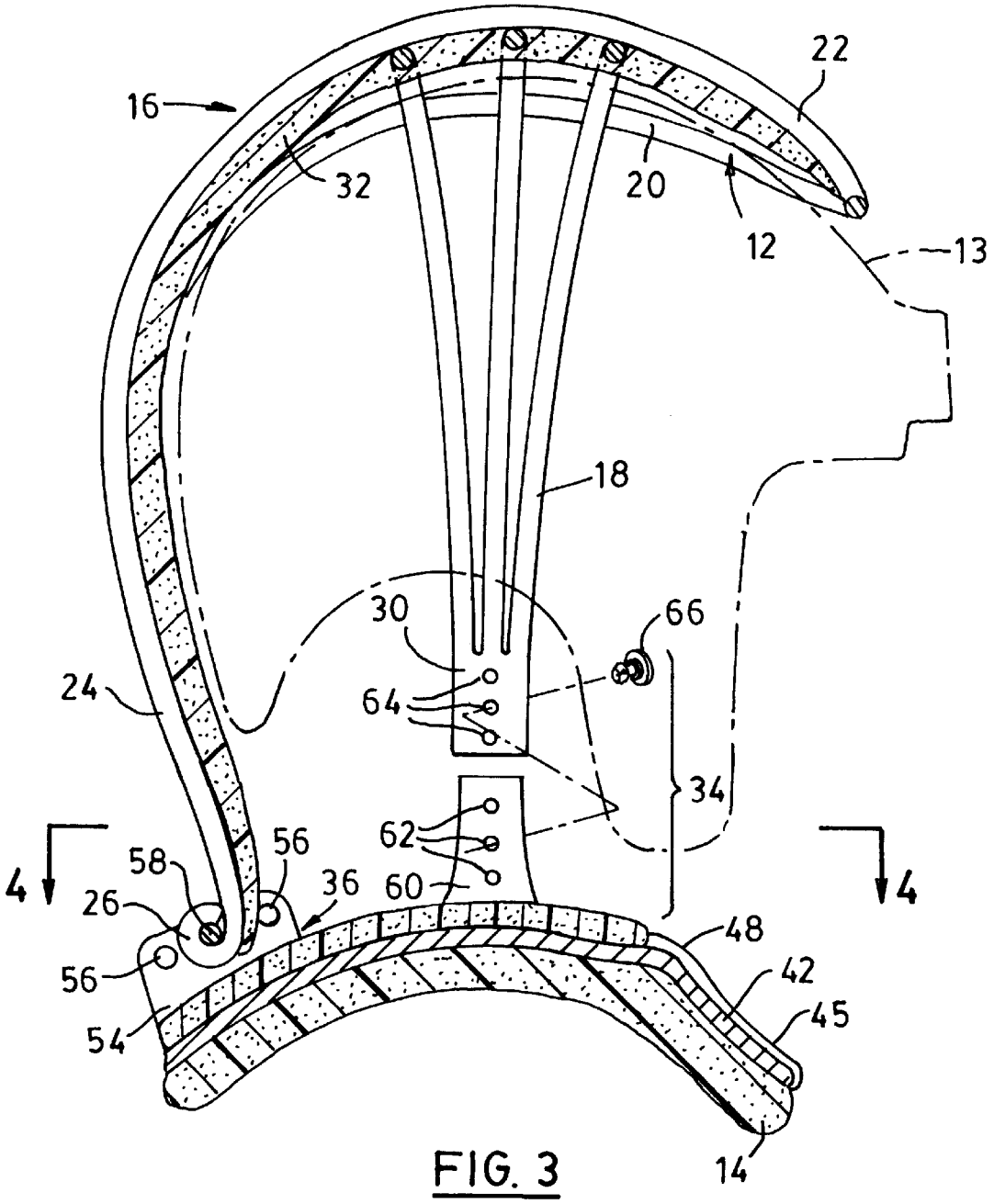
FIG. 3 is a sectional view taken along the centre line of the protective head gear.
Figure 4:
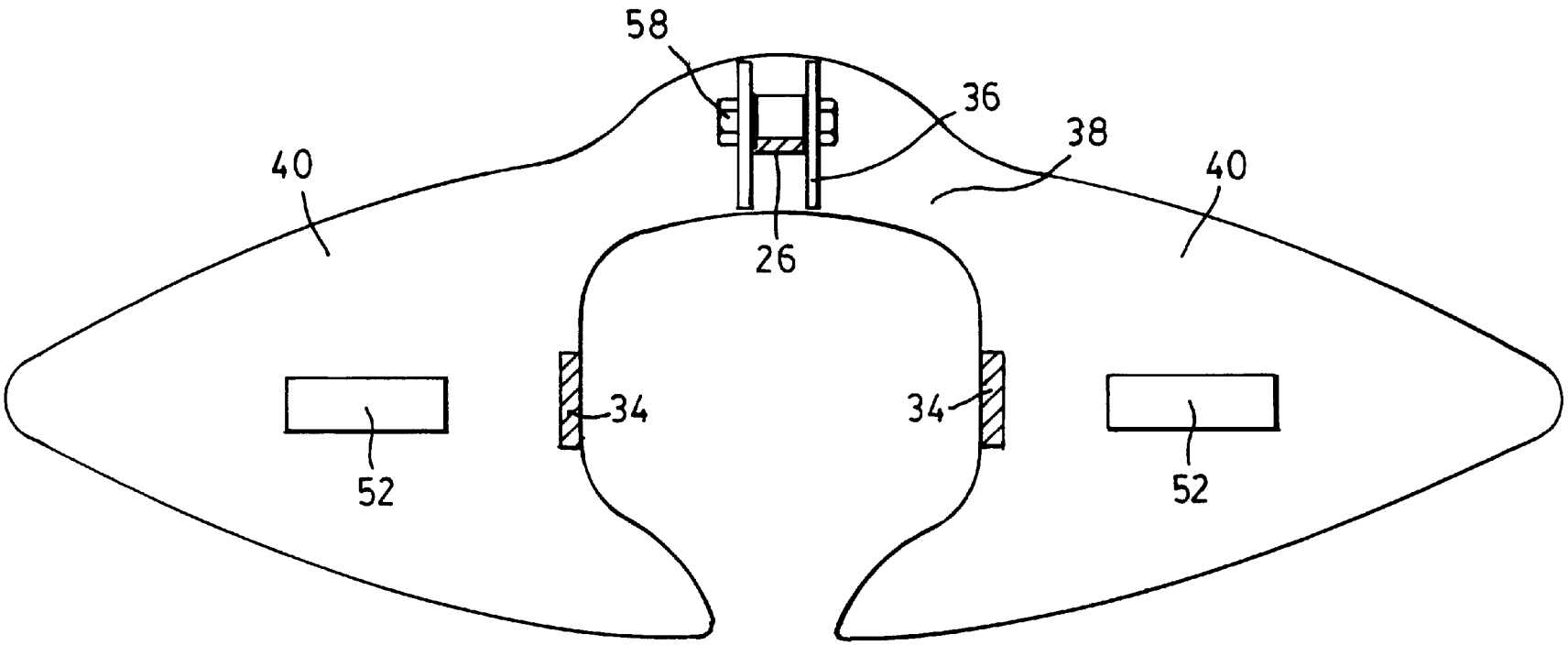
FIG. 4 is a section view taken along line 4—4 of FIG. 3.

Referring to FIGS. 1, 2 and 3, the protective head gear of the present invention is shown generally at 10. Protective head gear 10 includes a head portion 12 and a neck or collar portion 14.

Head portion 12 is spaced upwardly and outwardly from the athlete's helmet 13 and head 15, as best seen in FIG. 3. The head portion is spaced such that the athlete can rotationally move his/her head. Thereby the athlete can freely move his/her head from side to side. The movement of the athlete's head up and down will be restricted by head portion 12.

The head portion 12 includes a central or crown segment 16 and a pair of opposed side segments 18. Preferably the central or crown segment 16 is made from a plurality of generally spaced apart crown rods 20. FIG. 2 shows three crown rods 20 and the central one thereof 22 is made of stronger material than the remainder of the crown rods 20. The plurality of crown rods 20 converge at the crown base 24 proximate to the connection to the collar portion 14. At the crown base 24 the crown rods 20 are fused or welded such that they act as one piece. The central crown rod 22 may extend below the remainder of the crown rods 20 and be bent to form a loop 26 as best seen on FIG. 3. Loop 26 forms part of the coupling which will be described in more detail below.

Similarly the pair of side segments 18 are made from a plurality of spaced apart side rods 28. Preferably both side segments 18 are formed from the same set of rods 28. FIG. 3 shows three side rods 28, the central side rod 29 of which is made from stronger material. The side rods 28 converge proximate to the side base 30 of the head portion 12. It will be appreciated by those skilled in the art that a larger or smaller number of rods for the crown segment 16 and the side segments 18 could be used as long as the head portion 12 can withstand severe impact.

Crown rods and side rods 28 are shaped to generally conform to the athlete's head but spaced therefrom as described above. Padding 32 (shown in FIG. 3) may be provided on the inside of the head portion 12.

Neck or collar portion 14 is adapted to be connected to the head portion 12 at the crown base of the crown segment 16 and at the side base of the pair of side segments 18. The collar portion 14 includes a pair of side coupling devices 34 to releasably connect it to the side segments 18 of the head portion 12. In addition there is an adjustable back coupling device 36 for hingeably connecting the collar portion 14 to the crown segment 16 of the head portion 12.

Figure 6:
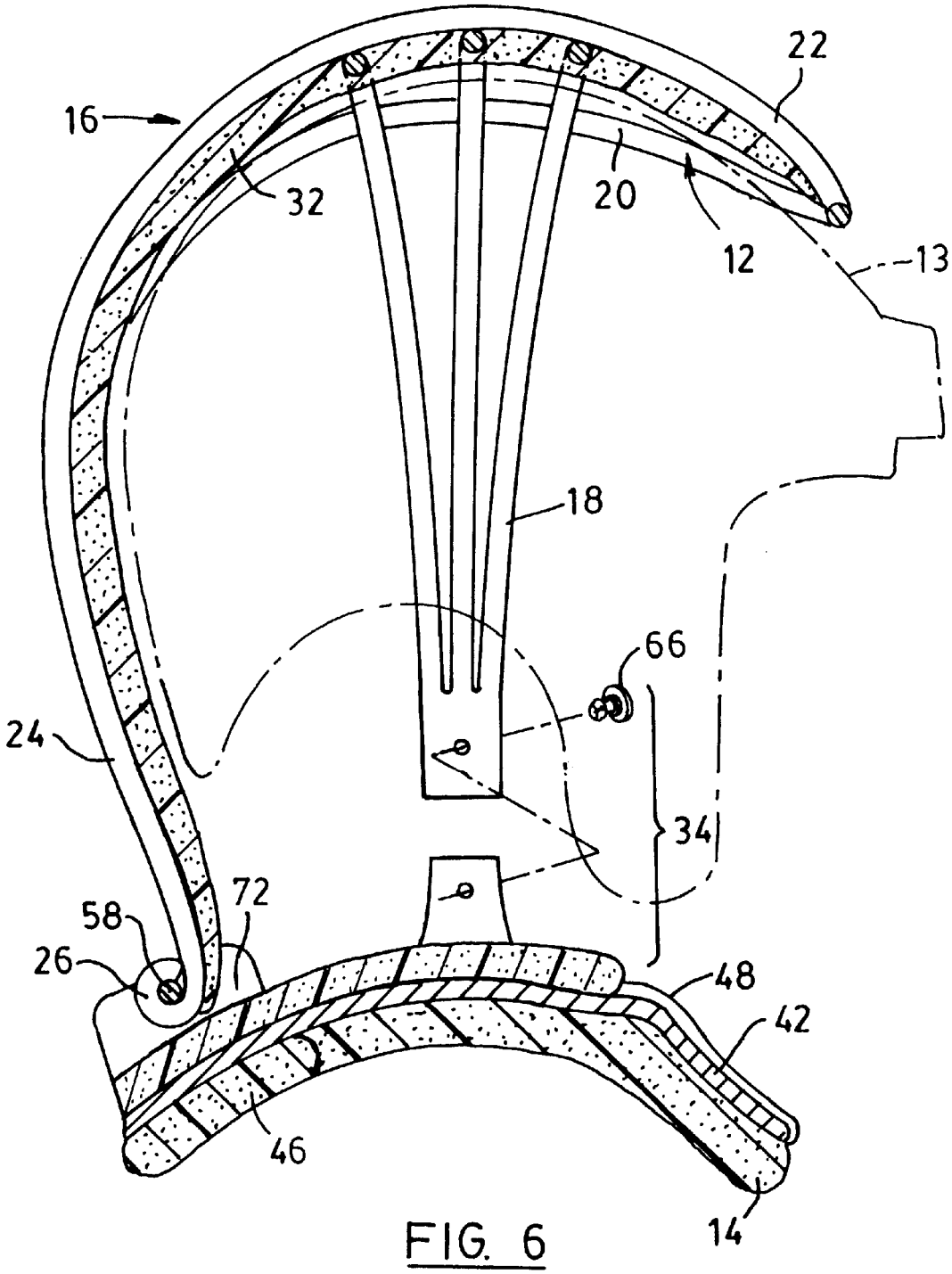
FIG. 6 is a sectional view taken along the centre line of the protective head gear showing an alternate embodiment of a side coupling device and an alternate embodiment of a back coupling device.

Collar portion 14 includes a neck segment 38 and shoulder segments 40. Neck segment 38 is made from a plurality of layers, including a generally rigid layer 42 of strong generally rigid material, shown in FIG. 3, such as metal or strong rigid plastic. A soft protective layer 44 such as vinyl-covered sponge 44 is attached to the underside of generally rigid layer 42 to provide some cushioning between the athlete and the generally rigid layer 42. A top covering 45 may be used to provide some protection between the athlete and the top of the generally rigid layer 42. The thickness of the top covering 45 may vary as need. For example, at the front of the collar portion 14 the top covering may be thicker so that there is padding between the athlete's chin and the generally rigid layer 42. Alternatively no top covering is used as shown in FIG. 6.

Protective layer 44 may be one continuous piece attached to the underside of generally rigid layer 42. Alternatively a sturdy fibrous pad 46 (shown in FIG. 6) is attached to the generally rigid layer 42 under the back coupling unit 36. Pad 46 provides protection for the back of the user from the force delivered to the central crown segment 16 down to back coupling devices 36 and side couplings 34. Neck segment 38 is contoured to go around the neck, slightly down the back and front. Neck segment 38 has a ridge 48 formed therein so that it contours over the clavicle bone in the shoulder forming a slight bridge over the bone.

Shoulder segments 40 extend outwardly from neck segment 38 and are made from soft padding. Shoulder segments 40 extend outwardly across the shoulder and slightly over its edges. Straps 50 are provided and in use are positioned under the arms of the athlete to attach collar portion 14 to the athlete. Alternatively the straps 50 may be positioned under the user's arms, across the body in front and connected to opposite sides thereof.

Neck or collar portion 14 is adapted to fit easily under the conventional shoulder pads that may be used in football, hockey players or the like. A pair of strips 52 of hook type fasteners are positioned on the top of collar portion 14 on each side thereof. The hook type fastener engages loop type fasteners (not shown) affixed to the underside of conventional shoulder pads.

There are a number of different coupling devices that may be used to connect the head portion 12 to the collar portion 14. A number of examples are shown herein but it will be appreciated by those skilled in the art that there are a number of possible variations which are not specifically shown. However, all of the coupling devices have the same basic characteristics. The back or crown coupling device attaches the crown segment 16 of the head portion 12 to the collar portion 14 with a hingeable or rotational connection. The side segments 18 of the head portion 12 are releasably connected to the collar portion 14.

Referring to FIG. 3, a back bracket 54 is attached to the back central region of collar portion 14. Back bracket 54 has a plurality of holes 56 formed therein adapted to receive bolt 58. Bolt 58 fits loosely through loop 26 and loop 26 can move freely therearound. Bolt 58, with loop 26 thereon is secured in bracket 54. A pair of side brackets 60 extend upwardly from collar portion 14. Side brackets 60 have a plurality of side bracket holes 62 formed therein. Similarly side segments 18 have a plurality of holes 64 formed therein. A quick release connector 66 connects one side bracket hole 62 to one side segment hole 64.

The protective head gear of the present invention has now been generally described. There are a number of variations that will now be described which show some variations that are clearly still within the scope of the invention herein.

Figure 5:
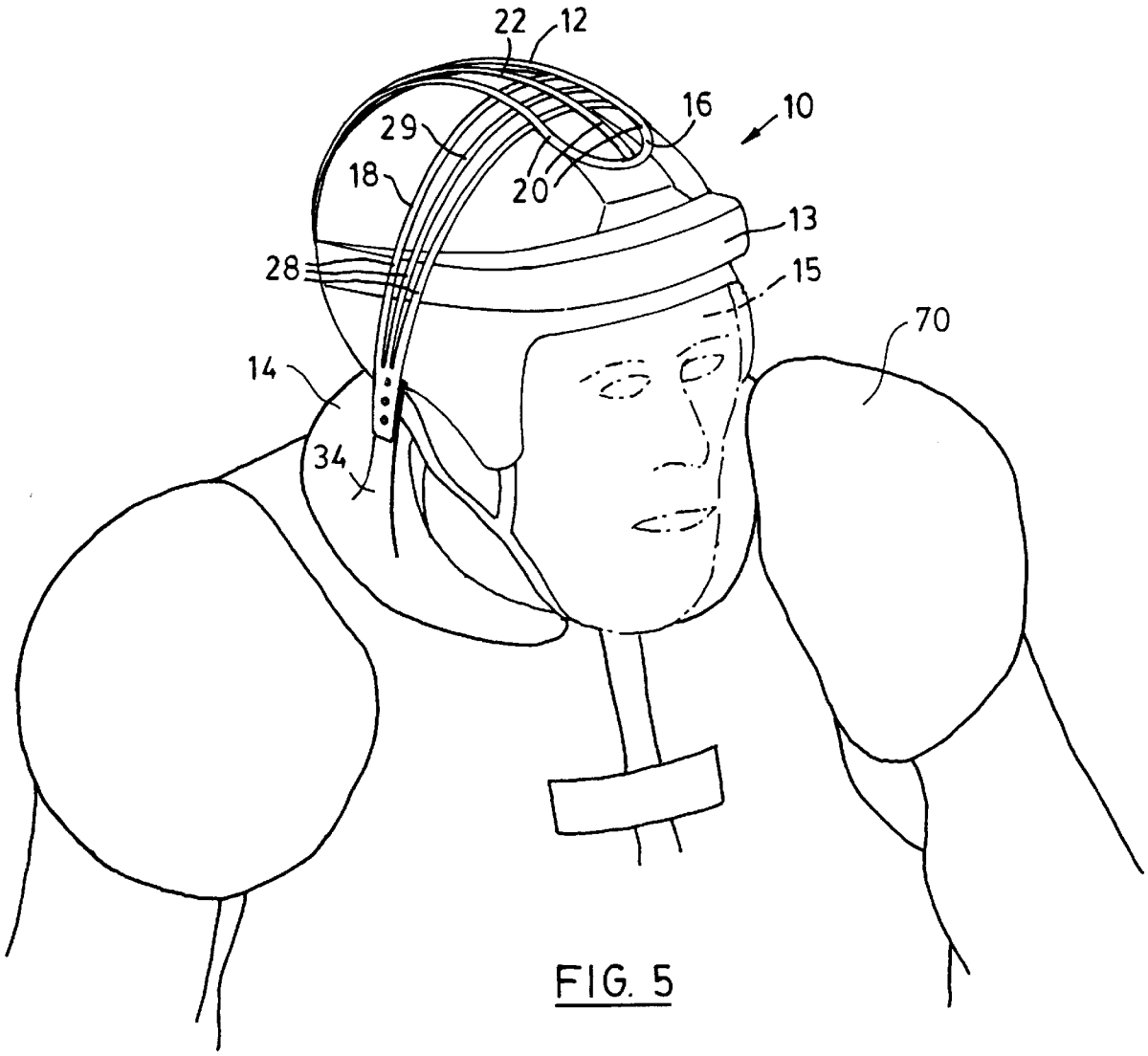
FIG. 5 is a perspective view of an alternate embodiment of the head gear of the present invention with the collar portion incorporated as part of conventional pads.

Referring to FIG. 5, the collar portion 14 is incorporated as part of conventional shoulder pads 70. Accordingly, the rigid material, back coupling device and pair of side coupling devices described above with regard to the collar portion 14 are included in modified shoulder pad 70.

Referring to FIG. 6, an alternate back coupling device 72 is shown which does not include the adjustability feature described above. Similarly and alternate side coupling device 73 is shown which does not include the adjustability feature described above. However, the side coupling 73 is releasably attachable.

Figure 7:
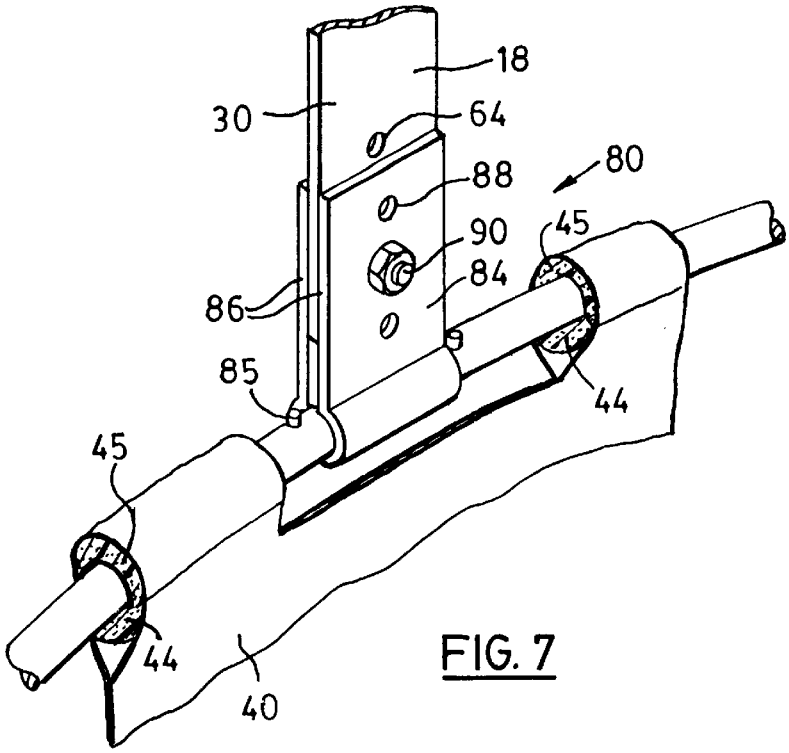
FIG. 7 is an enlarged perspective view of an alternate embodiment of a side coupling device.

Referring to FIG. 7, an alternate embodiment of a side coupling device is shown generally at 80. Side coupling device 80 includes an engagement portion attached to the neck segment 38. A portion of the top covering 45 and soft protective layer 44 is removed to reveal the neck segment 38. Engagement portion 84 can be pushed onto the neck segment 38 and fits tightly therearound. Engagement portion 84 includes grips 85 and a pair of spaced apart arms 86. Grips 85 are made from resiliently deformable material so that they grip neck segment 38. In use, the pair of spaced apart arms 86 are on either side of the side base 30 of the side segment 18. Each arm 86 has a plurality of holes 88 formed therein in registration with a corresponding plurality of holes in the corresponding arm 86. A bolt 90 extends through holes 88 in each arm 86 and a side segment hole 62. In use the athlete can adjust the position of the head portion 12 by changing the position of the side segment 18 in relation to the arm 86. Under impact on the head of the athlete there will be a force downwardly into the neck segment 38. Thus if under impact bolt 90 failed, the protective head gear 10 will still restrict the movement of head towards the spine because movement of the side base of the side segment would be restricted.

Figure 8:
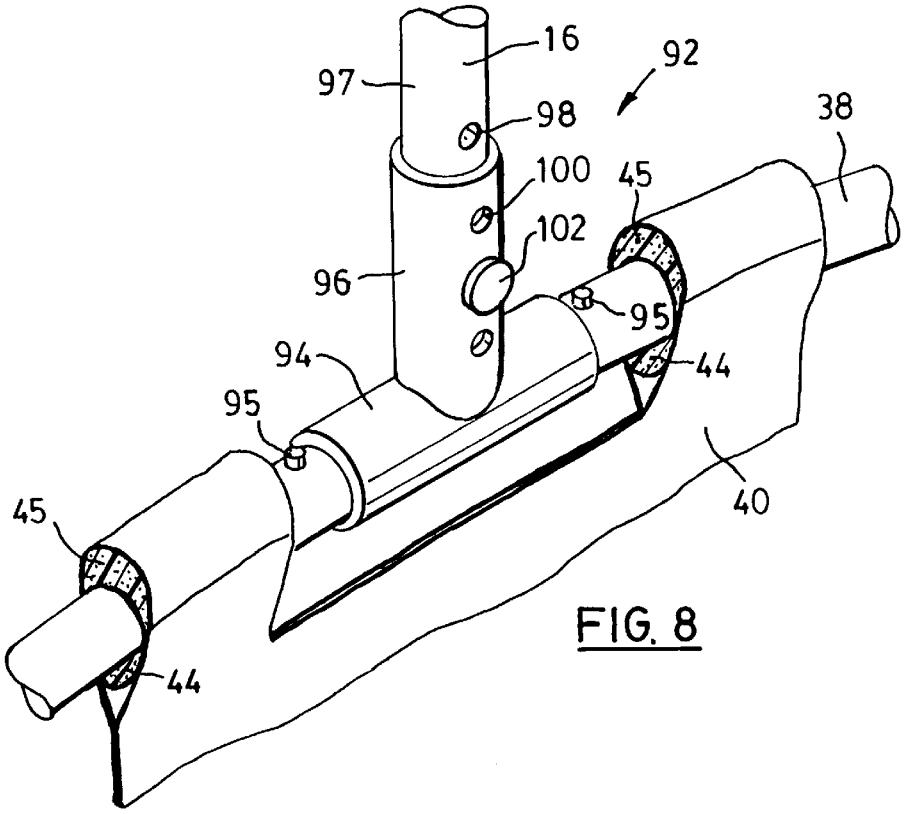
FIG. 8 is an enlarged perspective view of an alternate embodiment of a back coupling device.

Referring to FIG. 8, an alternate embodiment of a back coupling device is shown generally at 92. Back coupling device 92 includes a rotating bottom portion 94 which is adjustably connect to the crown segment 16. Rotating bottom portion 94 fits around the back of neck segment 38. Stoppers 95 restrict the movement of rotating bottom portion 94 along the neck segment 38. A portion of the top covering 45 and soft protective layer 44 is removed to reveal the neck segment 38. Rotating bottom portion 94 has a generally tubular portion extending outwardly 96 which in use surrounds a crown base 97 having a generally circular cross section of the crown segment 16. The crown base 97 of crown segment 16 has a plurality of holes 98 formed therein as compared to the loop 26 described above. Tubular portion 96 has a plurality of holes 100 formed therein that extend in registration through both sides of the tubular portion 96. A bolt 102 extends through holes 102 in both sides of tubular portion 96 and a hole 100 in crown segment 16. In use the athlete can adjust the position of the head portion 12 by changing the position of the crown segment 16 in relation to the arm 96. Under impact on the head of the athlete there will be a force downwardly into the rotating bottom portion 94 and into the neck segment 38. Thus if under impact bolt 102 failed the protective head gear 10 will still restrict the movement of head towards the spine because movement of the side base of the side segment would be restricted.

It will be appreciated by those skilled in the art that the tubular connection between the crown base 97 of crown segment 16 and neck segment 38 shown in FIG. 8 could also be used for the side coupling with a resiliently deformable engagement portion 84 shown in FIG. 7.

Figure 9:
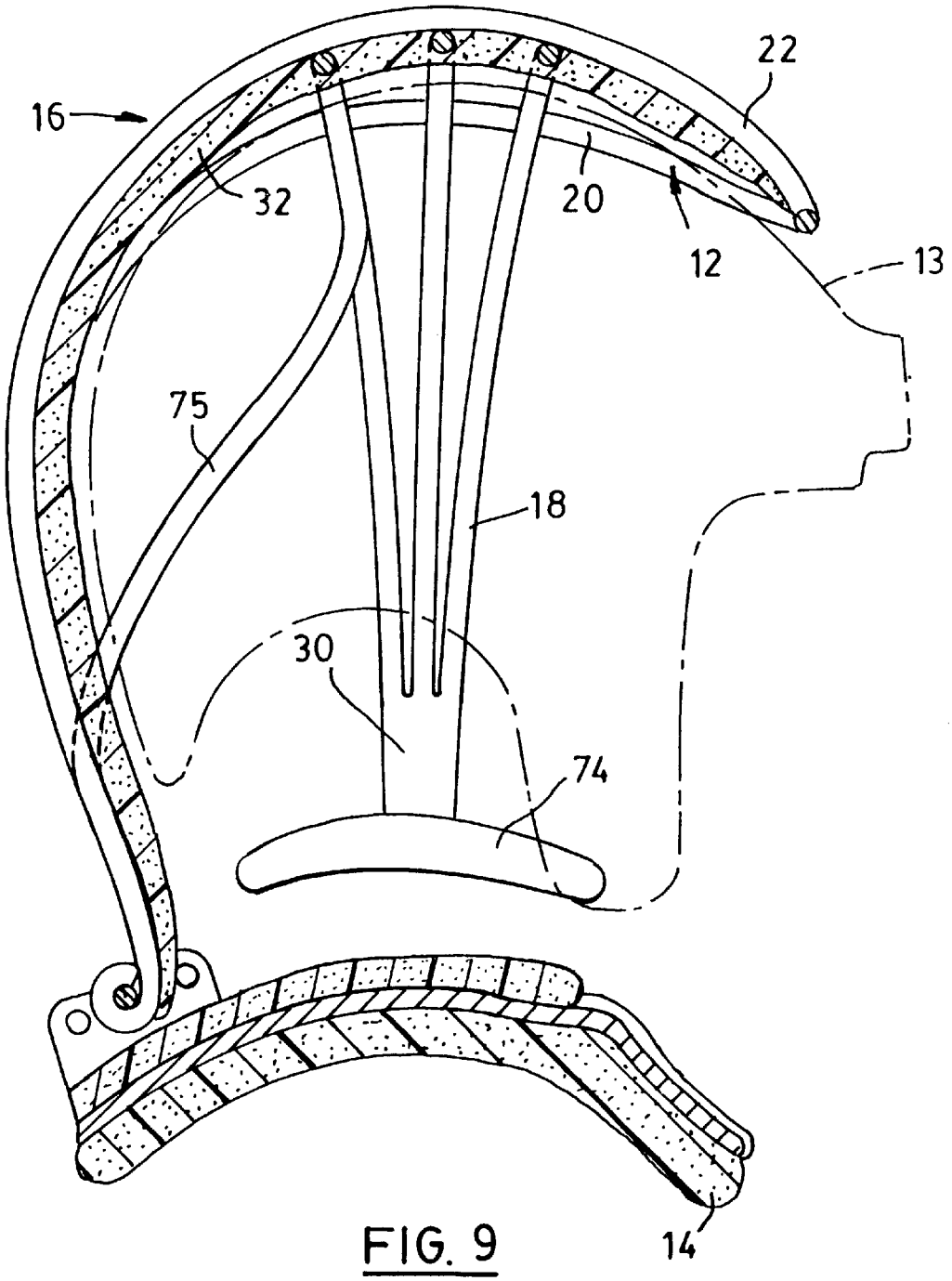
FIG. 9 is an enlarged perspective view similar to FIG. 2 but showing shoulder rests attached to the side base of the side segments.

Referring to FIG. 9 a shoulder rests 74 is attached to the side base 30 of each side segment 18. Each shoulder rest 74 is contoured and padded to rest comfortably on the users shoulder. In addition this embodiment shows a side reinforcing bar 75 that extends between the crown segment 16 and the side segment 18.

Figure 10:
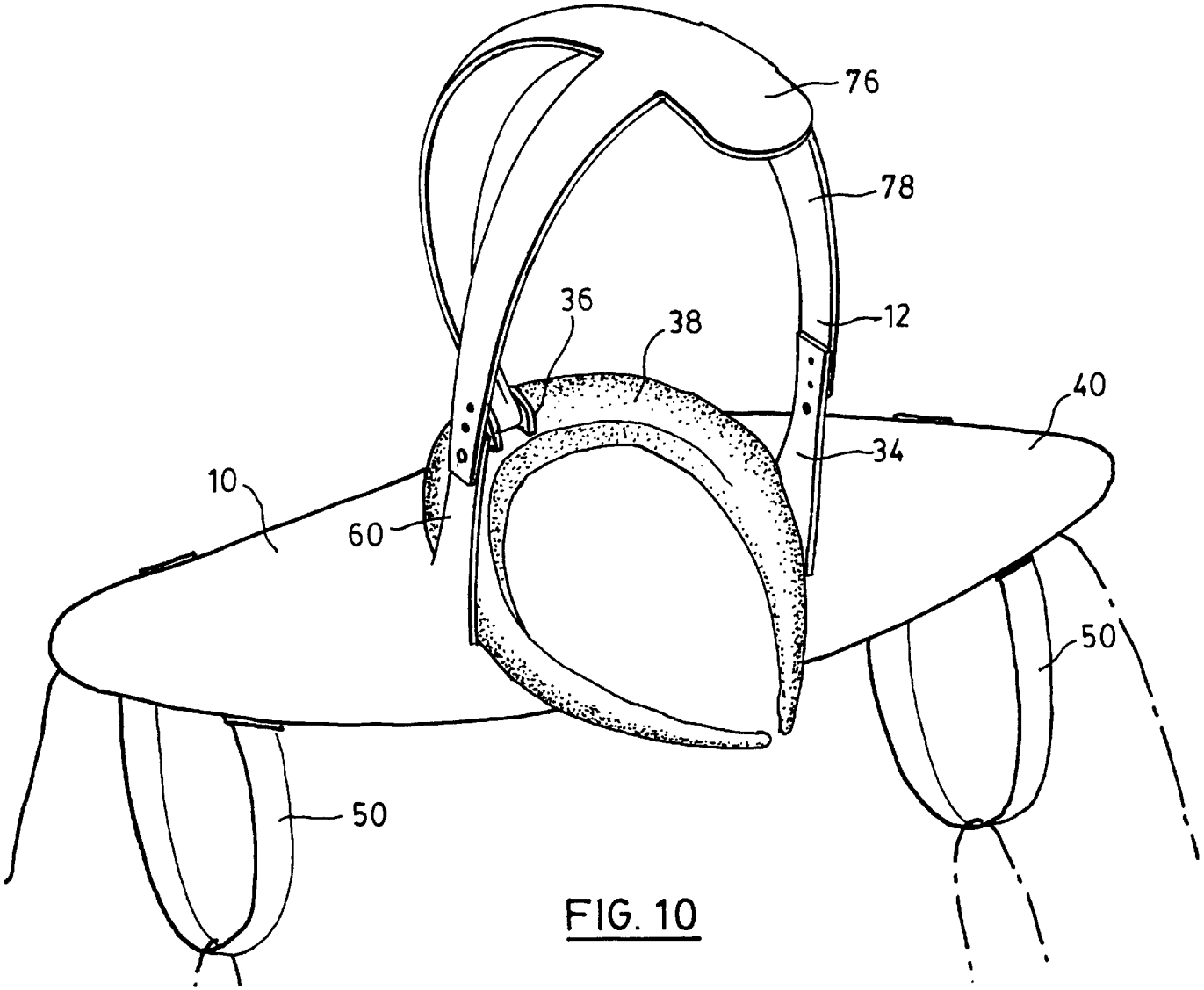
FIG. 10 is an enlarged perspective view of an alternate embodiment similar to FIG. 1 but showing solid crown and side segments.

Referring to FIG. 10, an alternate embodiment is shown wherein crown segment 76 and side segments 78 are made from solid rigid material such as plastic.

There are a number of advantages that the head gear 10 of the present invention provides over the prior art. It provides a practical and light way to prevent the horror of severe trauma and spinal cord damage by minimizing compaction (axial loading) of the vertebra in the cervical area. The technical advantage of head gear 10 is that it does what a conventional helmet (head gear) is not designed to do. Head gear 10 is independent of the helmet underneath it. Head gear 10 has an open concept to enhance visibility, lighten it and at the same time withstand high compaction force. Further, it is easily removable and can be moved out of the athlete's way by flipping it back. The shoulder segment 40 of the collar portion 14 conveniently lies under the traditional shoulder pads used in such sports as hockey or football. Even if the head portion 12 is removed the collar portion 14 will provide some protection to the clavicle area on the athlete. The head portion 12 is adjustable both at the back coupling device 36 and the side coupling device 34, and this allows the head portion 12 to be moved up and down for fitting purposes. Further, the head portion 12 can be flipped backwardly like a hood by releasing each side coupling devices 34. The head portion 12 is designed to receive impact, primary at or near the top of head and direct the force to the athlete's shoulders and back area.

It will be appreciated that the above description related to embodiments by way of example only. Many variations on the invention will be obvious to those skilled in the art and such obvious variations are within the scope of the invention as described herein whether or not expressly described.

What is claimed as the invention is:

1. A protective head gear for use in contact sports by an athlete wearing a helmet comprising:

a generally open head portion having a crown segment extending backwardly and downwardly from a crown to a crown base and a pair of opposed side segments each having a side base, the head portion is spaced upwardly and outwardly from the helmet, the crown segment and each side segment being contoured to and spaced from the shape of the helmet, the crown base being adapted to be positioned at the back of the athlete's neck;

a collar portion rotatably connected to the crown base, the collar portion having a generally rigid layer adapted to be positioned around the athlete's neck and to transmit the force from a hit on the head portion to the collar portion; and a means for attaching the collar portion to the athlete.

2. A protective head gear as claimed in claim 1 further including a pair of side releasable coupling devices one between each of the side segments and the collar portion.

3. A protective head gear as claimed in claim 2 wherein the crown segment is a plurality of spaced apart rods that converge at the base thereof.

4. A protective head gear as claimed in claim 3 wherein opposed side segments are made from contiguous material and each side segment is a plurality of spaced apart rods that converge at the base thereof.

5. A protective head gear as claimed in claim 2 wherein the rotatable connection between the crown segment and the collar is adjustable and each side releasable coupling device is adjustable.

6. A protective head gear as claimed in claim 2 wherein the attaching means are a pair of straps having one end attached to a portion of the collar portion and the opposed end releasably attached to another portion of the collar portion.

7. A protective head gear as claimed in claim 2 wherein the collar portion forms a part of protective shoulder pads.

8. A protective head gear as claimed in claim 1 further including a pair of shoulder rests one attached to the base of each side segment.

9. A protective head gear as claimed in claim 1 further including a pair of side reinforcing bars each extending between the crown segment and one side segment.

10. A protective head gear as claimed in claim 2 wherein each side releasable coupling device includes a side bracket having a hole formed therein and a quick release connector and the quick release connector is attachable to a hole formed in the side base and the hole in the side bracket.

11. A protective head gear as claimed in claim 10 wherein there is a plurality of holes formed in the side bracket and a plurality of holes formed in the side base.

12. A protective head gear as claimed in claim 2 wherein each side releasable coupling device includes a resiliently deformable engagement portion connected to the side base, adapted to grip the collar portion.

13. A protective head gear as claimed in claim 12 wherein the connection between the side base and the resiliently deformable engagement portion is adjustable.

14. A protective head gear as claimed in claim 13 wherein the side base is generally tubular and the resiliently deformable engagement portion is generally tubular and the side base fits snugly inside the generally tubular resiliently deformable engagement portion.

15. A protective head gear as claimed in claim 1 wherein the rotatable connection between the crown base and the collar portion includes a rotatable bottom portion fitting snugly around the collar portion and a portion extending outwardly from the rotatable bottom portion attached to the crown base.

16. A protective head gear as claimed in claim 15 wherein the portion extending outwardly from the rotatable bottom portion is adjustably attached to the crown base.

17. A protective head gear as claimed in claim 16 wherein the crown base is generally tubular and fits snugly within the portion extending outwardly from the rotatable bottom portion.

18. A protective head gear as claimed in claim 1 further including padding attached to an underside of the generally rigid layer.

19. A protective head gear as claimed in claim 18 further including padding attached in the inside of the head portion.

20. A protective head gear as claimed in claim 19 further including a top covering attached to the top of the generally rigid layer.

* * * * *